US006982428B2

(12) United States Patent
Stresau et al.

(10) Patent No.: US 6,982,428 B2
(45) Date of Patent: Jan. 3, 2006

(54) PARTICLE DETECTION BY ELECTRON MULTIPLICATION

(75) Inventors: Richard Stresau, Sydney (AU); Kevin Hunter, Glenhaven (AU); Wayne Sheils, Winmalee (AU); Peter Raffin, Petersham (AU); Yair Benari, Hornsby (AU)

(73) Assignee: ETP Electron Multipliers Pty Ltd, Ermington (AU)

( * ) Notice: Subject to any disclaimer, the term of this patent is extended or adjusted under 35 U.S.C. 154(b) by 105 days.

(21) Appl. No.: 10/758,015

(22) Filed: Jan. 16, 2004

(65) Prior Publication Data

US 2004/0159796 A1 Aug. 19, 2004

(30) Foreign Application Priority Data

Jan. 20, 2003 (AU) ..... 2003900277

(51) Int. Cl.
*G21G 5/00* (2006.01)
*H01J 25/50* (2006.01)
*H01J 19/82* (2006.01)

(52) U.S. Cl. ..... 250/492.3; 250/370.1; 313/103; 313/104; 315/39.63

(58) Field of Classification Search ..... 250/492.3, 250/370.1; 313/103, 104; 315/39.63; 327/572
See application file for complete search history.

(56) References Cited

U.S. PATENT DOCUMENTS 2,175,697 A * 10/1939 Nelson ..... 315/12.1
3,735,184 A * 5/1973 Maeda ..... 313/105 R
4,164,681 A * 8/1979 Catanese ..... 313/400
4,199,702 A * 4/1980 Keneman ..... 313/105 R
5,367,218 A * 11/1994 Comby ..... 313/105 CM
5,616,987 A * 4/1997 Ohmura et al. ..... 313/533
5,656,807 A * 8/1997 Packard ..... 250/214 VT
5,665,966 A * 9/1997 Dahl et al. ..... 250/281
5,680,008 A * 10/1997 Brandes et al. ..... 313/533
5,748,464 A * 5/1998 Schuetz ..... 363/131
5,777,538 A * 7/1998 Schuetz ..... 336/173
5,841,231 A * 11/1998 Kimura et al. ..... 313/532
5,883,392 A * 3/1999 Schuetz ..... 250/492.3
5,997,713 A * 12/1999 Beetz et al. ..... 205/124
6,014,118 A * 1/2000 Edwards et al. ..... 345/75.2
6,642,637 B1 * 11/2003 Spallas et al. ..... 313/103 R
6,833,913 B1 * 12/2004 Wolf et al. ..... 356/237.2
6,841,936 B2 * 1/2005 Keller et al. ..... 313/533

* cited by examiner

*Primary Examiner*—Nikita Wells
*Assistant Examiner*—Kalimah Fernandez
(74) *Attorney, Agent, or Firm*—Venable LLP; Catherine M. Voorhees

(57) ABSTRACT

Electron focussing apparatus includes a cathode plate defining an impact surface on which particles impact, which surface has a finite probability of generating at least one electron for each impacting particle having predetermined characteristics. The apparatus also has an electron receiving element, and respective means for generating electrostatic and magnetic fields in a space extending from the impact surface to the electron receiving element. The means for generating the electrostatic and magnetic fields are configured whereby the $E/B^2$ ratio adjacent the electron receiving element is smaller than adjacent the impact surface, whereby to decrease the radius of curvature of the electron trajectories adjacent the electron receiving element relative to adjacent the impact surface and to thereby focus the electron trajectories in at least one dimension. In another aspect the electron receiving element is positioned and the means for generating the electrostatic and magnetic fields are configured to cause the electrons to deflect on average through greater than 180° before impacting the electron receiving element, whereby to focus, in at least one dimension, multiple electrons generated from any given area of the impact surface to a smaller area at the electron receiving element.

35 Claims, 1 Drawing Sheet

PARTICLE DETECTION BY ELECTRON MULTIPLICATION

FIELD OF THE INVENTION

This invention relates generally to the detection of particles and is concerned in particular with enhancements for this purpose of electron multiplier configurations.

In the context of this specification, a "particle" may be an ion or other charged particle, a neutral particle or a photon, that is capable, when having predetermined characteristics, to cause an impacted surface to generate an electron. A common application of electron multipliers, however, is the detection of specific ions, for example in mass spectrometers, and hence for convenience particles to be detected will sometimes be referred to herein as ions.

BACKGROUND ART

To optimise the performance of an electron multiplier, it is often desirable to have a large sensitive input area so that particles can be detected which are incident over a large area. This requirement often results in a mis-match between the desired sensitive input area and the sensitive area of the amplifying section of the electron multiplier (which can be much smaller). In this case it is desirable to include a focussing element, usually referred to as a focussing lens, between the device's input aperture and its amplifying section.

As well as enabling the detector to have a large sensitive input area, a number of additional requirements for the focussing lens will be necessary if the device is to be used for special applications such as time-of-flight mass spectrometry (TOF-MS). For TOF-MS applications it is critical to accurately measure the arrival time of the ions that are detected over the sensitive input area. To achieve this objective, the focussing lens, at least in a preferred form, should be such as to contribute little or no distortion to the relative measured arrival times of input ions. Expressed another way, if multiple ions arrive at the detector and are spread uniformly over the input area and are all coincident in time, the electrons (resulting from these ions) exiting the focussing lens should all impact the first dynode of the amplifying section substantially in coincidence.

The amplifying section may be a discrete dynode electron multiplier, a continuous dynode electron multiplier, a micro channel plate, a micro sphere plate, a focussed mesh detector, a magnetically focussed electron multiplier, a magnetic/electrostatic electron multiplier (also known as a cross field detector) or any other device that can be used to amplify the signal electrons.

A focussing lens typically includes an ion impact plate as the first element of the lens assembly. This ion impact plate is an integral component of most ion detectors and has the function of converting the input ions, to be detected, into electrons. The emission of low-energy secondary electrons from the impact plate, typically as a beam of electrons, is the desired response to the plate being struck by sufficiently energetic particles, and forms the principal signal to be amplified by the detector. In addition to the desired secondary electrons, the incoming signal ions may cause numerous other interactions that may generate particles within the detector. These particles include:

a) Grid ions: Ions that are emitted from the detector's entry grid as a result of an impact on the grid by a signal ion. They can be positive or negative, low energy or high energy.

b) Grid electrons: Electrons that are emitted from the detector's entry grid as a result of an impact on the grid by a signal ion.

c) Grid neutrals: Neutral atoms or molecules that are emitted from the detector's entry grid as a result of an impact on the grid by a signal ion.

d) Impact plate ions: Secondary ions that are emitted from the detector's impact plate as a result of an impact on the plate by a signal ion. They can be positive or negative, low energy or high energy.

e) Impact plate neutrals: Neutral atoms or molecules that are emitted from the detector's impact plate as a result of an impact on the plate by a signal ion.

For time-of-flight mass spectrometry all particles resulting from these interactions within the detector (apart from secondary electron emission from the impact plate) generate unwanted artefact signals in the detector output. Such artefacts are usually seen as unwanted small peaks in the mass spectrum, which are not coincident with the primary signal associated with the incoming ion, and thus add confusion when interpreting the spectrum. It is desirable to eliminate or minimise these artefacts so that they no longer unduly interfere with the intended signal.

In short, a primary objective of the invention is therefore to spatially focus electrons resulting from the impact of the particles to be detected, sometimes referred to as the signal or signal carrying particles or signal or signal carrying electrons, without degradation of the timing information.

SUMMARY OF THE INVENTION

The present invention proposes three mechanisms for achieving the just-mentioned objective that may each be employed alone, in conjunction in the same electron deflection, or sequentially. Each mechanism takes advantage of the secondary electrons that result from the impact of energetic electrons or ions against a surface. A surface able to function in this way is hereinafter referred to as a dynode. Each mechanism involves deflection of electrons by an electrostatic field in conjunction with a magnetic field preferably generally orthogonal or nearly orthogonal to the electrostatic field, in contrast to the typical environment of most commercial electron multipliers in which deflection is by electrostatic field only.

In the combined magnetic and electrostatic field arrangements of the present invention, the low energy secondary electrons will preferably follow a near cycloidal trajectory path in such a combination of fields. The distance the electron travels along a surface (x) in this near cycloidal trajectory (and its radius of curvature) will be proportional to the electrostatic field strength(E) divided by the square of the magnetic field strength (B): $x=K*E/B^2$. (K=a constant). Therefore, this $E/B^2$ ratio is a convenient way of defining the system's operational parameters.

The first mechanism involves deflection of the electrons from one dynode to another in a combined field where the $E/B^2$ ratio is decreased from the electron emitting dynode to the next target dynode. The target dynode may be the input of the amplifying section. The second mechanism involves deflection of electrons through an angle greater than 180° in a combined field with either a uniform or non-uniform $E/B^2$ ratio. This latter technique has optimal time coherence for deflections at or near 180°, at or near 270°, or at or near 360° (and larger multiples of 90°) and has greatest magnification or focussing capability at or near 270°. The third mechanism involves deflection of electrons in a combined field with either a uniform or non-uniform $E/B^2$ ratio along the axis of net electron migration. A magnetic field which is uniform and strictly orthogonal to the electrostatic field will result in no electron focussing in a dimension parallel to the nominal magnetic field direction. In the third mechanism, an appropriate shape of the magnetic field results in variations from a field that is strictly orthogonal to the electrostatic field which further results in focussing the electrons in a second dimension (the dimension which is generally parallel to the nominal magnetic field direction).

In a first aspect, the invention provides a particle detector employing electron multiplication, comprising:

cathode means defining an impact surface on which particles impact, which surface has a finite probability of generating at least one electron for each impacting particle having predetermined characteristics;

a plurality of electron multiplication dynode segments, including a first dynode segment, arranged in an array; and respective means for generating electrostatic and magnetic fields in a space extending from said impact surface past said dynode segments, whereby said electrons cascade and multiply successively along said array of dynode segments;

wherein said means for generating said magnetic and electrostatic fields are configured whereby the $E/B^2$ ratio adjacent any of said dynode segments is smaller than adjacent the preceding dynode segment or impact surface relative to the direction of the cascade, whereby to decrease the radius of curvature of the electron trajectories along said cascade and to thereby focus the electron trajectories in at least one dimension, preferably in at least two dimensions.

Preferably, the $E/B^2$ ratio is progressively decreased from the first dynode segment or impact surface to the next dynode. In one embodiment, the decrease is confined to the region from the impact surface to the first dynode segment or to the amplifying section. In another embodiment, there is alternatively or additionally a progressive decrease in the $E/B^2$ ratio along the dynode array.

In its first aspect, the invention also provides electron focussing apparatus comprising:

cathode means defining an impact surface on which particles impact, which surface has a finite probability of generating at least one electron for each impacting particle having predetermined characteristics;

an electron receiving element; and respective means for generating electrostatic and magnetic fields in a space extending from said impact surface to said electron receiving element;

wherein said means for generating said electrostatic and magnetic fields are configured whereby the $E/B^2$ ratio adjacent said electron receiving element segment is smaller than adjacent the impact surface, whereby to decrease the radius of curvature of the electron trajectories adjacent the electron receiving element relative to adjacent the impact surface and to thereby focus the electron trajectories in at least one dimension, preferably in at least two dimensions.

Preferably, the $E/B^2$ ratio is progressively decreased from the impact surface to the electron receiving element.

Preferably, said magnetic field is configured to also focus the electron trajectories in a direction generally orthogonal to the overall direction of said trajectories.

In a second aspect, the invention provides a particle detector employing electron multiplication, comprising:

cathode means defining an impact surface on which particles impact, which surface has a finite probability of generating at least one electron for each impacting particle having predetermined characteristics;

a plurality of electron multiplication dynode segments, including a first dynode segment, arranged in an array; and respective means for generating electrostatic and magnetic fields in a space extending from said impact surface past said dynode segments, whereby said electrons cascade and multiply successively along said array of dynode segments;

wherein said first dynode segment is positioned and said means for generating said electrostatic and magnetic fields are configured to cause said electrons to deflect on average through greater than 180° before impacting the first dynode segment, whereby to focus, in at least one dimension, multiple electrons generated from any given area of said impact surface to a smaller area at said first dynode segment.

Preferably, for optimal time coherence, the average deflection is through substantially or approximately a multiple of 90°. In an especially convenient configuration, the average deflection is through substantially 270°, which results in the greatest magnification or focussing capability for the structure.

Preferably, said dynode array is substantially coplanar. In the case of 270° deflection, the result is that the direction of particle incidence on the impact surface is substantially parallel to the plane of the dynode array, an especially convenient configuration.

The dynodes may be discrete or segments of a continuous dynode formed, for example, from resistive secondary electron emissive material.

In its second aspect, the invention further provides electron focussing apparatus comprising:

cathode means defining an impact surface on which particles impact, which surface has a finite probability of generating at least one electron for each impacting particle having predetermined characteristics; and an electron receiving element;

respective means for generating electrostatic and magnetic fields in a space extending from said impact surface to said electron receiving element;

wherein said electron receiving element is positioned and said means for generating said electrostatic and magnetic fields are configured to cause said electrons to deflect on average through greater than 180° before impacting the electron receiving element, whereby to focus, in at least one dimensions, multiple electrons generated from any given area of said impact surface to a smaller area at said dynode segment.

Preferably, for optimal time coherence, the deflection is through substantially a multiple of 90°. In an especially convenient configuration, the deflection is through substantially 270°, which results in the greatest magnification or focussing capability for the structure.

In a third aspect, the invention provides a particle detector employing electron multiplication, including:

cathode means defining an impact surface on which particles impact, which surface has a finite probability of generating at least one electron for each impacting particle having predetermined characteristics;

a plurality of electron multiplication dynode segments, including a first dynode segment, arranged in an array; and respective means for generating electrostatic and magnetic fields in a space extending from said impact surface past said dynode segments, whereby said electrons cascade and multiply successively along said array of dynode segments;

wherein said means for generating a magnetic field comprises at least two magnetic poles positioned with respect to said cathode means to generate a magnetic field extending in a direction generating generally orthogonal or nearly orthogonal to said electrostatic field but configured to cause focussing, in said direction, of trajectories of said electrons from said impact surface to said first dynode segment.

A magnetic field which is uniform and strictly orthogonal to the electrostatic field will result in electron focussing in only one dimension (the dimension of net migration for the electrons). Appropriate position and shape of the magnetic pole pieces can result in variations from a strictly orthogonal magnetic field direction which can further result in focussing the electrons in a second dimension (the dimension which is parallel to the nominal magnetic field direction).

In the third aspect, the invention also provides electron focussing apparatus comprising:

cathode means defining an impact surface on which particles impact, which surface has a finite probability of generating at least one electron for each impacting particle having predetermined characteristics; and an electron receiving element;

respective means for generating electrostatic and magnetic fields in a space extending from said impact surface to said electron receiving element;

wherein said means for generating a magnetic field comprises at least two magnetic poles positioned with respect to said cathode means to generate a magnetic field extending in a direction generating generally orthogonal or nearly orthogonal to said electrostatic field and configured to cause focussing, in said direction, of trajectories of said electrons from said impact surface to said electron receiving element.

The invention further extends to an electron focussing apparatus or a particle detector incorporating two or three of the three aspects of the invention. A preferred form of such apparatus or detector has all three aspects of the invention controlling the electron trajectories from the impact surface to the amplifying section.

In all aspects of the invention, the electron receiving element is preferably a dynode segment.

The invention also extends to an electron multiplier comprising a particle detector according to one or more of the first, second and third aspects of the invention.

In each aspect of the invention, the impact surface may itself be a dynode for generating electrons in response to impacting electrons. Typically, the impact surface is associated with an entrance grid.

BRIEF DESCRIPTION OF THE DRAWINGS

A preferred embodiment of the invention will now be described, by way of example only, with reference to the accompanying diagrams, in which.

Embodiments of the Invention

Figure 1:
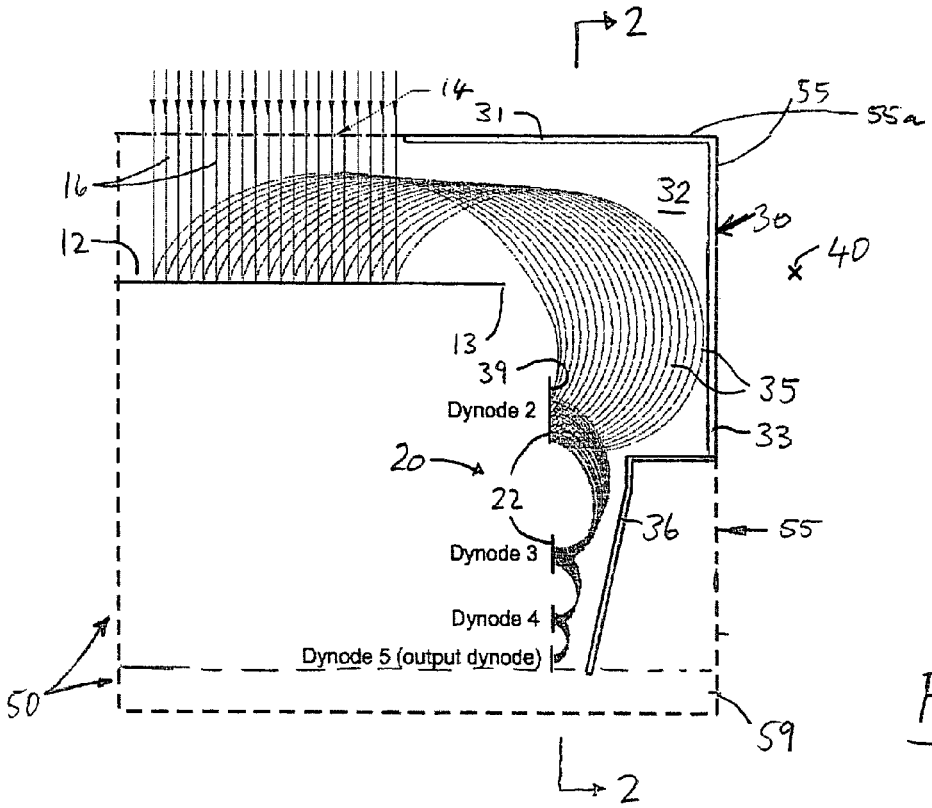
FIG. 1 is a cross-sectional schematic representation of a focussing configuration for an electron multiplier, which configuration incorporates simultaneous and sequential co-operating application of the three aspects of the invention to focussing of the secondary electron trajectories.

The illustrated electron multiplier 10 includes cathode means in the form of a relatively large ion impact plate 12 constituting an input dynode, designated dynode 1. Dynode 1 is disposed inwardly of an entrance grid 14 defining an input aperture. Typical input ion trajectories are indicated at 16.

A co-planar or linear array 20 of dynodes 22 extends at 90° to impact plate 12 in a direction behind and away from plate 12 relative to entrance grid 14. The plane of dynode array 20 lies slightly laterally of the adjacent edge 13 of plate 12. Dynodes 22 are designated dynodes 2, 3, 4 and 5 and are successively smaller in functional surface area. Dynodes 22 are also at a spacing from the preceding dynode that successively diminishes from dynode 2 to dynode 5. Dynode 5 is the output dynode of the focussing configuration and marks the start of the amplifying section 24 (FIG. 2).

Figure 2:
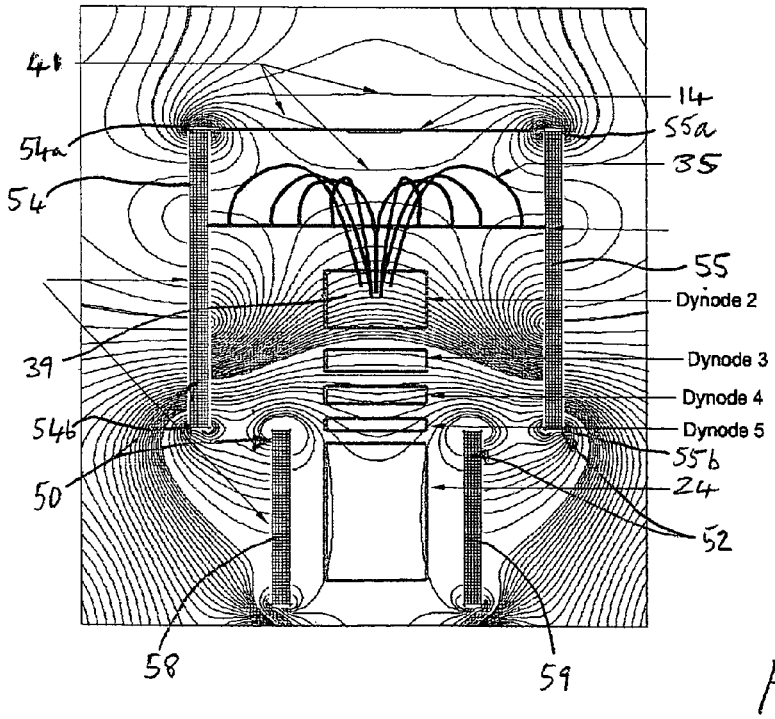
FIG. 2 is a cross-section on the line 2—2 in FIG. 1, extended at its lower end and depicting the field strength contour lines for the magnetic field generated by the depicted pole configuration.

A rectangular plate 30 is disposed as shown as an electrode for shaping an electrostatic field between it and dynodes 1 and 2, while a pair of opposed mirror-image magnetic pole configurations 50,52 (FIG. 2) are provided to generate a magnetic field 40 generally or nearly orthogonal to the electrostatic field in a direction (the z-axis direction) into the page of FIG. 1 or from pole to pole in FIG. 2. Field shaping electrode 30 has segments 31, 33 in planes respectively parallel to but spaced from dynodes 1 and 2. These plate segments 31, 33, together with pole configurations 50,52 and dynodes 1 and 2, define a chamber 32 in which secondary electrons generated by plate 12 are guided along trajectories 35 to dynode 2 by the combined effect of the electrostatic field and magnetic field 40.

Progressively more positive voltages are applied between the successive dynodes 1 to 5 to ensure that electrons passing from one dynode to the next have sufficient energy to generate secondary electrons on impact. Voltages must be applied to the entrance grid 14 and field shaping electrode 30 that are more positive than the dynode 1 voltage so that they attract electrons emitted from dynode 1. The $E/B^2$ ratio is continually decreased from the top to the bottom of the diagram, in this case by increasing the strength of magnetic field 40. This is effective, as shown by the illustrated trajectories, to progressively focus the trajectories in at least the one dimension (the x or y dimension) parallel to the page in the diagram of FIG. 1.

Instead of increasing the magnetic field strength (B), B may be held substantially constant while the electrostatic field is reduced, or a suitable balance may be obtained that progressively reduces the $E/B^2$ ratio from dynode 1 or 2 to dynode 5, but achieves optimum voltages at the various electrodes for optimum overall performance.

Field shaping plate 30 is extended by an attractor plate 36 that lies spaced from dynodes 2 to 5, but is closer to the array than electrode plate segment 33 and is inclined so as to converge downwardly towards the plane of the dynode array 20. The attractor plate 36 may be a separate electrode and/or at a different voltage than the field shaping plate 30.

During operation, ions enter on trajectories 16 through a uniform electrostatic field generated between the ion impact surface (dynode 1) and parallel entrance grid 14. Secondary electrons (generated from the ion impact) are deflected along trajectories 35 by the combined effect of the electrostatic and magnetic fields through an average angle of approximately 270° to dynode 2. This is effective to focus the electrons generated from any given area of impact plate 12 (dynode 1) to a smaller area at dynode 2. In some configurations the impact plate 12 may need its end to be bent up (not shown in diagram) at its right hand end (as seen in FIG. 1) to maintain a near uniform electrostatic field over the ion input portion. This is to minimise time distortion of transit times of input ions traversing between the entrance grid and the ion impact plate.

In this example, the $E/B^2$ ratio in the dynode 1 area is ~$10^9$ volts/(meter-tesla$^2$) and the $E/B^2$ ratio is decreased by ~20 times from the top to the bottom of the structure as shown in the diagram. Both of these are practical values. The first stage of focussing from dynode 1 to dynode 2 will reduce the beam size, ie. its cross-section, to between 20% and 25% of the input beam size. The overall beam cross-section reduction for the entire lens assembly (dynode 1 to dynode 5) will be>20:1. Analysis has shown that with the appropriate choice of design parameters this structure will contribute less than 300 picoseconds of distortion between the arrival time of coincident ions striking the impact plate and the arrival of electrons at the output dynode 5 of the focussing lens assembly.

FIG. 2 provides the detail of the magnetic pole configuration which includes two sets of magnetic field strength contour lines 41, each set indicating contours of equal magnetic field strength. For the set in the higher field strength region (lower center of FIG. 2.) only every $5^{th}$ contour is shown (as compared with the lower field strength region). Primary pole pieces 54, 55 control the magnetic field shape in the dynode 1 area and extend from upper edges 54*a*, 55*a* generally aligned with entrance grid 14 to bottom edges 54*b*, 55*b* generally aligned with dynode 5. As illustrated in FIG. 2, dynode 1 extends between pole pieces 54, 55, while dynodes 2, 3, 4 and 5 are of substantially smaller lateral extent but are centrally located between pole pieces 54, 55. Enhancement of intensity below this region is achieved by upstanding pole pieces 58, 59 that extend downwardly from a plane joining the facing aligned bottom edges 54*b*, 55*b* of pole pieces 54, 55.

Thus far in the discussion, reference has been made to focussing of the electron trajectories in the x and y directions, i.e. the dimensions parallel to the page in FIG. 1. Focussing in the z direction is also obtained by the magnetic pole and field configuration depicted in FIG. 2. Firstly, the increasing field strength from dynode 2 to dynode 5 and the field shape achieved by pole pairs 54, 55 and 58, 59 combine to centralise or focus the "beam" of electron trajectories 35 in the z direction. Secondly, the positioning of the upper edges 54*a*, 55*a* of pole pieces 54, 55 near the level of entrance grid 14 is found to generate an advantageous edge effect that focuses, in the z direction, the electron trajectories 35 between impact plate 12 and dynode 2. These edge effects cause a curvature of the magnetic field, as represented by the magnetic field strength contours 41 (FIG. 2), which deflects the electrons towards the center of the structure in the z direction.

Because the lens assembly utilises magnetic fields in the electron deflection process all other particles will be excluded. Magnetic deflection is mass sensitive and as a result ions and neutrals will experience very little or no deflection in a magnetic field designed for electrons. The only particles that will reach dynode 2 in this device are electrons that originate at the impact plate surface with low energy. Therefore the lens assembly will generate minimal artefact signals in TOF-MS applications.

In the described implementation and diagram, dynodes 2 to 5 are shown as separate electrodes: each has a conductive surface 39 that faces plate segment 33 or plate 36, and these surfaces 39 have different applied voltages. As an alternative these separate dynodes could be replaced by a single resistive dynode. In such an implementation the resistive dynode would consist of an electrically resistive surface where a voltage is applied between two opposite ends so that the voltage measured on the surface varies continually from one end to the other. The surface must also have sufficient secondary electron yield so that incident electrons generate enough secondary electrons to sustain the process through each of the required stages (electron impact followed by secondary electron emission). The inherent secondary electron emission of the surface material may be suitable for this process, or the surface may need to be coated with a more suitable material. As a practical matter it is desirable that the secondary electron yield at each impact should be greater than 1, but the device would still function with smaller secondary electron yield.

Secondary electron yield of any material is almost always a strong function of the electron impact energy, which in turn is derived from the voltage difference between the electron emission surface and the electron impact surface. Thus, the voltage applied between the two ends of the resistive dynode must be great enough so that there is sufficient voltage between electron emission and impact positions to generate secondary electrons. The distance between emission and impact positions will be determined by the combined electrostatic and magnetic field strengths.

It will be understood that all three of the aforedescribed mechanisms are used in the transition from dynode 1 to dynode 2. The focussing that occurs in the electron transitions from dynode 2 to 3, 3 to 4, and 4 to the output dynode 5 are embodiments of the first and third aspects of the invention.

All three aspects of the invention may be applied to an alternative structure in which dynodes 2 to 5 are not present but in their place, for example at the location of dynode 2, is an electron receiving element in the guise of a plate that is not strictly a dynode but is the start of the amplification section, or some kind of electron detector or transducer. By example, the input of a micro-channel plate or other electron multiplier, or a focussed mesh detector or Faraday cup, might be positioned at the location of dynode 2 in the drawings.

What is claimed is:

1. A particle detector employing electron multiplication, comprising:

cathode means defining an impact surface on which particles impact, which surface has a finite probability of generating at least one electron for each impacting particle having predetermined characteristics;

a plurality of electron multiplication dynode segments, including a first dynode segment, arranged in an array; and respective means for generating electrostatic and magnetic fields in a space extending from said impact surface past said dynode segments, whereby said electrons cascade and multiply successively along said array of dynode segments;

wherein said means for generating said magnetic and electrostatic fields are configured whereby the $E/B^2$ ratio adjacent any of said dynode segments is smaller than adjacent the preceding dynode segment or impact surface relative to the direction of the cascade, whereby to decrease the radius of curvature of the electron trajectories along said cascade and to thereby focus the electron trajectories in at least one dimension.

2. A particle detector according to claim 1, wherein said $E/B^2$ ratio is progressively decreased from the first dynode segment or impact surface to the next dynode.

3. A particle detector according to claim 1 wherein said $E/B^2$ ratio decreases in the region from the impact surface to the first dynode segment.

4. A particle detector according to claim 1 wherein there is a progressive decrease in the $E/B^2$ ratio along the dynode array.

5. A particle detector according to claim 1 wherein said dynode array extends in a direction behind said impact surface relative to the trajectories of said particles, in a plane disposed laterally of an adjacent edge of said impact surface.

6. A particle detector according to claim 1 wherein said dynode array is in a plane substantially at 90° to said impact surface.

7. A particle detector according to claim 1 wherein said magnetic field is configured to also focus the electron trajectories in a direction generally orthogonal to the overall direction of the trajectories.

8. A particle detector according to claim 1 wherein said first dynode segment is positioned and said means for generating said electrostatic and magnetic fields are configured to cause said electrons to deflect on average through greater than 180° before impacting said first dynode segment, whereby to focus, in at least one dimension, multiple electrons generated from any given area of said impact surface to a smaller area at said first dynode segment.

9. A particle detector according to claim 8, wherein, for optimal time coherence, the average deflection is through substantially a multiple of 90°.

10. A particle detector according to claim 9 wherein the average deflection is through substantially 270°.

11. A particle detector according to claim 1, wherein said dynode segments are discrete.

12. A particle detector according to claim 1, wherein said dynode segments are segments of a continuous dynode formed, for example, from resistive secondary electron emissive material.

13. A particle detector according to claim 1, wherein the electron trajectories are focussed in at least two dimensions.

14. A particle detector employing electron multiplication, comprising:

cathode means defining an impact surface on which particles impact, which surface has a finite probability of generating at least one electron for each impacting particle having predetermined characteristics;

a plurality of electron multiplication dynode segments, including a first dynode segment, arranged in an array; and respective means for generating electrostatic and magnetic fields in a space extending from said impact surface past said dynode segments, whereby said electrons cascade and multiply successively along said array of dynodes segments;

wherein said first dynode segment is positioned and said means for generating said electrostatic and magnetic fields are configured to cause said electrons to deflect on average through greater than 180° before impacting the first dynode segment, whereby to focus, in at least one dimension, multiple electrons generated from any given area of said impact surface to a smaller area at said first dynode segment.

15. A particle detector according to claim 14, wherein, for optimal time coherence, the average deflection is through substantially a multiple of 90°.

16. A particle detector according to claim 15 wherein the average deflection is through substantially 270°.

17. A particle detector according to claim 14 wherein said dynode array is substantially coplanar.

18. A particle detector according to claim 17, wherein the detection is through substantially 270°, and the direction of particle incidence on the impact surface is substantially parallel to the plane of the dynode array.

19. A particle according to claim 14, wherein said dynode segments are discrete.

20. A particle detector according to claim 14, wherein said dynode segments are segments of a continuous dynode formed, for example, from resistive secondary electron emissive material.

21. A particle detector according to claim 14 wherein said magnetic field is configured to also focus the electron trajectories in a direction generally orthogonal to the overall direction of the trajectories.

22. A particle detector employing electron multiplication, comprising:

cathode means defining an impact surface on which particles impact, which surface has a finite probability of generating at least one electron for each impacting particle having predetermined characteristics;

a plurality of election multiplication dynode segments, including a first dynode segment, arranged in an array; and respective means for generating electrostatic and magnetic fields in a space extending from said impact surface past said dynode segments, whereby said electrons cascade and multiply successively along said array of dynode segments;

wherein said means for generating a magnetic field comprises at least two magnetic poles positioned with respect to said cathode means to generate a magnetic field extending in a direction generally orthogonal or nearly orthogonal to said electrostatic field and configured to cause focussing, in said direction, of trajectories of said electrons from said impact surface to said first dynode segment.

23. A particle detector according to claim 22 wherein said dynode array extends in a direction behind said impact surface relative to the trajectories of said particles, in a plane disposed laterally of an adjacent edge of said impact surface.

24. Electron focussing apparatus according to claim 23 wherein said dynode array is in a plane substantially at 90° to said impact surface.

25. A particle detector according to claim 22 wherein said dynode segments are discrete.

26. A particle detector according to claim 22 wherein said dynode segments are segments of a continuous dynode formed, for example, from resistive secondary electron emissive material.

27. An electron multiplier comprising a particle detector according to claim 1.

28. An electron multiplier according to claim 27, wherein the impact surface itself is a dynode for generating electrons in response to impacting electrons.

29. An electron multiplier according to claim 27, wherein the impact surface is associated with an entrance grid.

30. An electron multiplier comprising a particle detector according to claim 14.

31. An electron multiplier according to claim 30, wherein the impact surface itself is a dynode for generating electrons in response to impacting electrons.

32. An electron multiplier according to claim 30, wherein the impact surface is associated with an entrance grid.

33. An electron multiplier comprising a particle detector according to claim 22.

34. An electron multiplier according to claim 33, wherein the impact surface itself is a dynode for generating electrons in response to impacting electrons.

35. An electron multiplier according to claim 33, wherein the impact surface is associated with an entrance grid.

* * * * *